United States Patent [19]

Cimock

[11] Patent Number: 4,967,321

[45] Date of Patent: Oct. 30, 1990

[54] FLASHLIGHT WAND

[75] Inventor: Benjamin J. Cimock, Altamonte Springs, Fla.

[73] Assignee: I & K Trading Company, Vienna, Va.

[21] Appl. No.: 270,170

[22] Filed: Nov. 14, 1988

[51] Int. Cl.[5] ..... F21L 1/00

[52] U.S. Cl. ..... 362/101; 362/102; 362/202; 362/806; 446/267; 446/485

[58] Field of Search ..... 362/101, 102, 109, 32, 362/202, 806; 446/267, 219, 159, 490, 485; 135/DIG. 10; D126/37, 38, 40, 42; D21/100; 84/477 B; D3/7

[56] References Cited

U.S. PATENT DOCUMENTS

| | | | |
|---|---|---|---|
| D. 155,130 | 4/1949 | Desforges, Sr. et al. | D21/100 |
| D. 284,487 | 7/1986 | Pratt | D21/100 |
| 2,242,981 | 5/1941 | Pedersen | 84/477 B |
| 2,362,131 | 11/1944 | Haggart, Jr. | 362/102 |
| 2,611,019 | 9/1952 | Warner | 362/102 |
| 4,055,840 | 10/1977 | Uchytil et al. | 362/32 |
| 4,231,077 | 10/1980 | Joyce et al. | 446/485 |
| 4,238,537 | 12/1980 | Kerr | 273/61 C |
| 4,600,974 | 7/1986 | Lew et al. | 362/102 |
| 4,666,417 | 5/1987 | Hillman | 446/267 |
| 4,675,234 | 6/1987 | Sachs et al. | 428/328 |

*Primary Examiner*—Ira S. Lazarus
*Assistant Examiner*—Richard R. Cole
*Attorney, Agent, or Firm*—Blum Kaplan

[57] ABSTRACT

A lighted wand includes a handle housing and contains an elongated transparent enclosure. Within the transparent enclosure are light reflecting objects. Light beams are transmitted through the transparent enclosure and deflect off the reflecting objects.

7 Claims, 2 Drawing Sheets

FLASHLIGHT WAND

BACKGROUND OF THE INVENTION

This invention is directed to a novel amusement device and, in particular, to a lighted wand that admits of light emission in a variety of directions and provides distinct types of play value.

Over the years, flashlights have been used for a variety of purposes. One such purpose is an amusement device for capturing the imagination of children. Although children will use the flashlight as a toy, the novelty of the standard flashlight will wear off quickly due, in large measure, to the absence of uses which are meaningful to a child. Toy manufacturers and amusement event manufacturers have developed several modifications of household flashlights that provide amusement value to children. One such flashlight is disclosed in U.S. Letters Pat. No. 3,877,171. Accordingly, an improved toy flashlight in the form of a lighted wand that admits light and contains light reflecting objects and, hence, provides enhanced and distinct play value is desired.

SUMMARY OF THE INVENTION

Generally speaking, in accordance with the instant invention, a lighted wand is provided. The lighted wand includes a handle housing for receiving a power supply. A light source is mechanically mounted to the handle housing and is adapted to be electrically coupled to the power supply for the purpose of selectively emitting a beam of light. A transparent enclosure is mounted to the handle housing so that light is emitted through the transparent enclosure. A plurality of light reflecting objects are distributed along the length of the transparent enclosure and cause light to be scattered and to reflect off of the objects to provide a distinctively lit wand.

Accordingly, it is an object of the instant invention to provide an improved amusement device in the form of a lighted wand.

A further object of the instant invention is to provide an amusement device which enables a child to have a lighting toyed which can reflect light and provide a distinct play value.

Still other objects and advantages of the invention will in part be obvious and will in part be apparent from the specification.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENT

Figure 1:
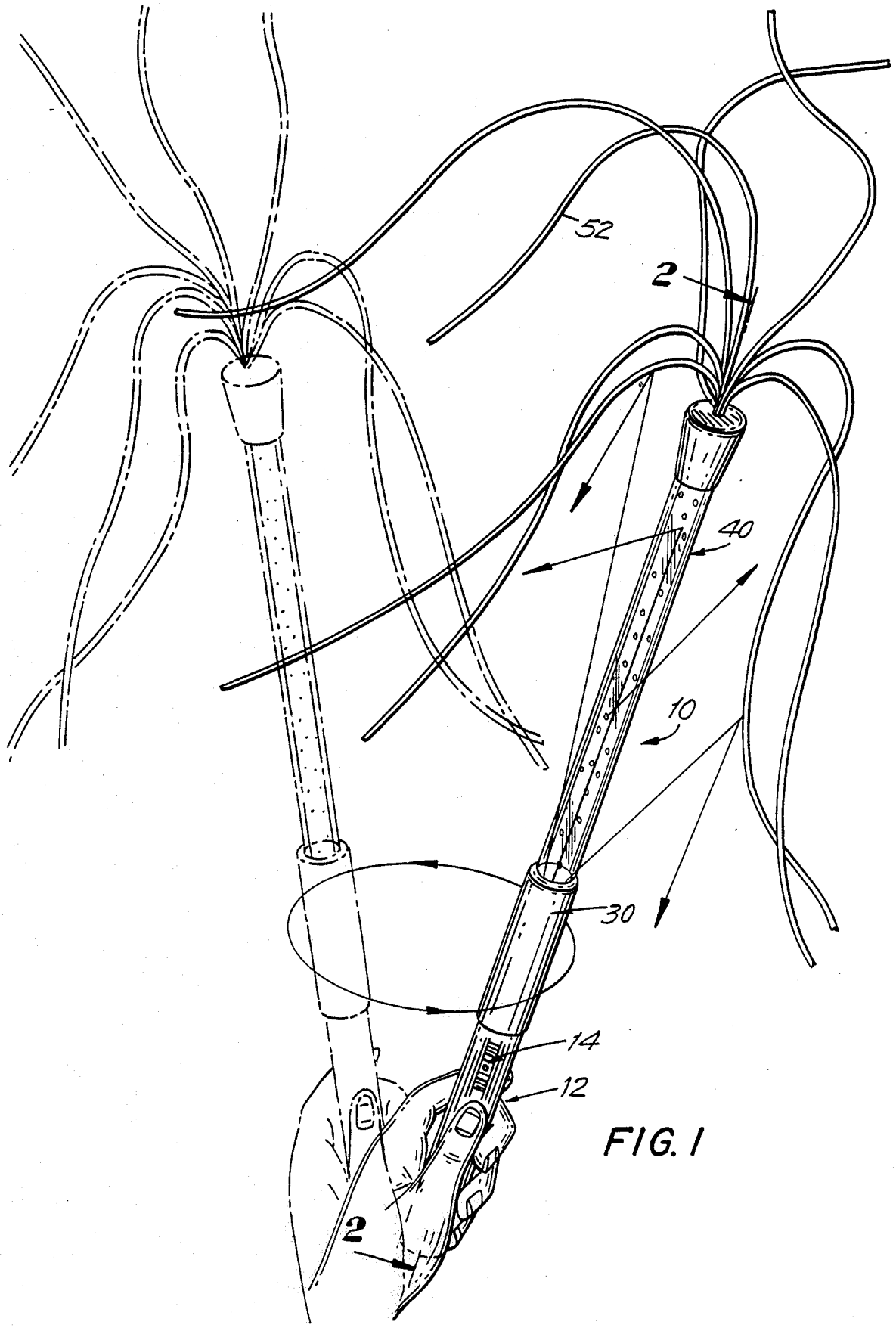
FIG. 1 is a perspective view of a lighted wand.

Reference is first made to FIG. 1, wherein a flashlight wand, generally indicated as 10, is depicted. Wand 10 includes handle assembly 12, including a displaceable on-off switch assembly, generally indicated as 14. Handle assembly 12 supports a light bulb assembly 30 and a transparent tube assembly 40 having light reflecting objects 42, commonly known as glitter, disposed therein.

Figures 2, 3:
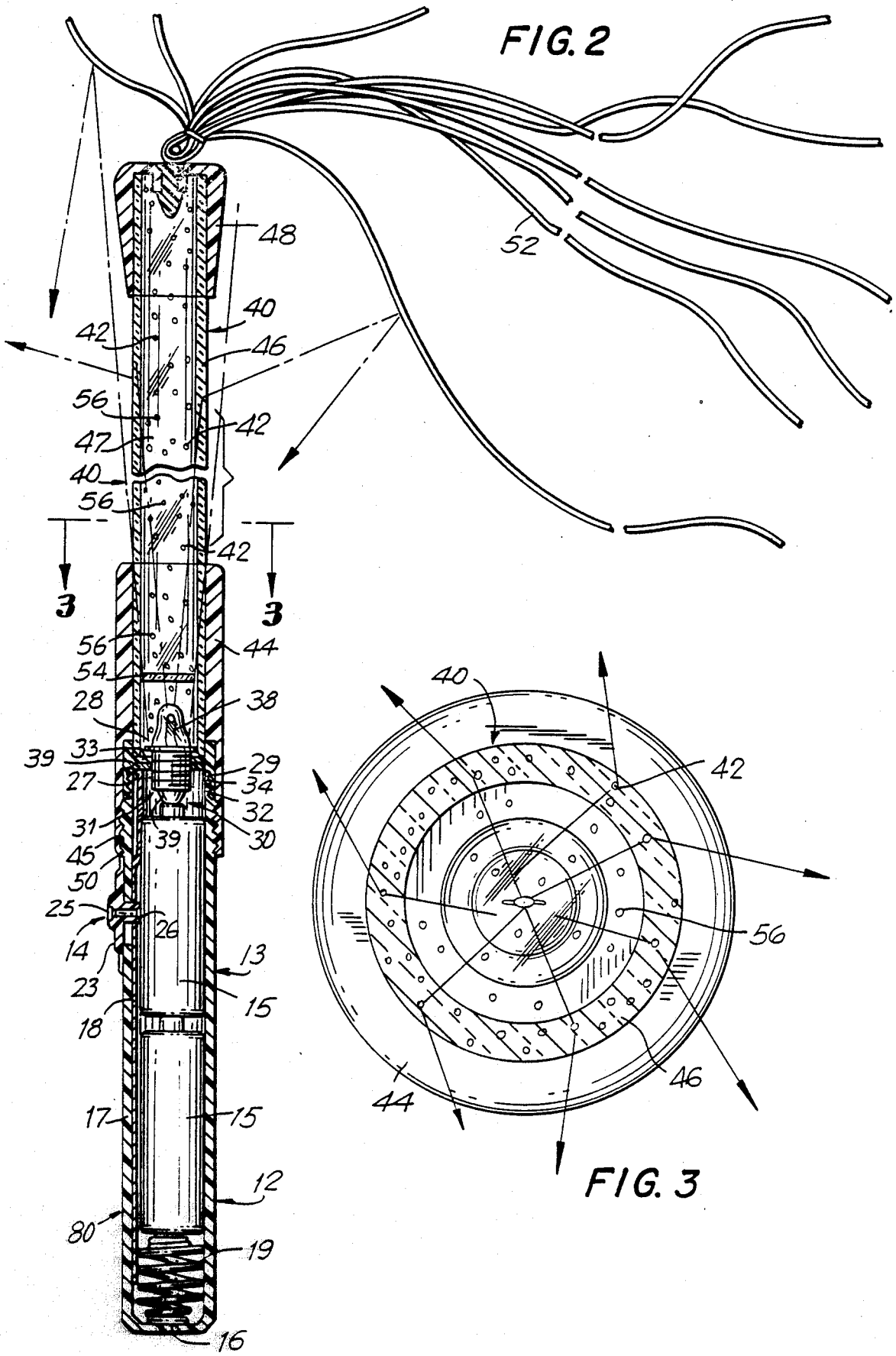
FIG. 2 is a sectional view taken along line 2—2 of the lighted wand of FIG. 1.
FIG. 3 is a sectional view taken along line 3—3 of FIG. 2.

Referring now to FIGS. 1–3, handle assembly 12 includes cylindrical housing 13 for receiving and positioning therein batteries 15. In particular, handle housing 13 including an end wall 16 and a cylindrical wall 17. A lead plate 18 is disposed against the inside of cylindrical wall 17 and extends along the length of it to the switch assembly 14. A conductor spring 19 is disposed against lead plate 18 to position the batteries 15 in the housing and couple the negative terminal of the battery 15 to lead plate 18.

Switch assembly 14 includes a switch plate 23 attached to conductive lead plate 18 and is secured thereto by inserting a rivet 25 through switch plate 23 into an opening 26 into lead plate 18. Lead plate 18 includes a contact portion 27 which extends toward the open end 28 of the cylindrical housing 13. At the open end 28 of cylindrical housing 17 are threads 29 annularly disposed about the open end of housing 17 for releaseably receiving the light bulb assembly 30.

Light bulb assembly 30 includes a housing 31 having a cylindrical wall 32 and a lateral collar support wall 33. Supporting wall 32 includes threads 34 on the inner surface thereof to permit light bulb assembly 30 to be releaseably secured to housing 13. Seated in the collar support wall 33 and holding a conventional light bulb 38 in position is a conductive collar 39. Conductive collar 39 extends into handle housing 13 and positions the bulb in contact with positive terminal battery 15 in a conventional manner.

Accordingly, bulb 38 is maintained in electrical contact with conductive collar 39 and is also in electrical contact with the positive terminal of battery 15. When switch 14 is moved in the direction of the transparent tube 40, contact portion 27 of lead 18 is placed in electrical contact with collar 39 to define a closed circuit, thus turning on light bulb 38 in a conventional manner.

Located on cylindrical housing 13 between switch plate 23 and light bulb assembly 30 are threads 50 annularly disposed about cylindrical housing 13 for releaseably receiving transparent tube assembly 40.

Transparent tube assembly 40 includes transparent tube supporting wall 44, transparent cylindrical wall 46 and a cap 48. Transparent tube supporting wall 44 includes threads 45 on the inner surface thereof for receiving further the threads 50 on cylindrical housing 13 to permit transparent tube assembly 40 to be releaseably secured to cylindrical housing 13.

Transparent tube supporting wall 44 supports transparent tube 47, which is an elongated transparent cylindrical wall 46. Distributed within support wall 44, along the length thereof, are light reflecting pieces 42 such as MYLAR®, commonly referred to as glitter. In an exemplary embodiment, the glitter is embodied in the supporting wall 44 when the wall is injection molded. At its distal end, transparent cylindrical wall 46 supports a cap 48. Finally, secured to cap 48 are strips of light reflecting material 52 preferably of MYLAR®.

In the embodiment depicted in FIG. 3, support wall 44 is closed off at its proximate end by a transparent lateral wall 54 to define a compartment in the tube.

Additional MYLAR ® pieces 56 are placed in transparent tube 47 before cap 48 is attached to transparent cylindrical wall 46. These reflecting pieces of glitter move freely within transparent tube 47, and, hence, cause random scattering when the tube is shaken in the manner depicted in FIG. 1.

Accordingly, the instant invention is characterized by a flashlight in the shape of a wand that is capable of imparting several distinct types of play value. For example, the glitter enclosed in the support walls causes light to be scattered. The glitter in the compartment causes light to be more randomly scattered when the wand is shaken. This provides a unique play value to the wand shaped flashlight of the instant invention.

It will thus be seen that the objects set forth above, among those made apparent from the preceding description, are efficiently attained and, since certain changes may be made in the above construction without departing from the spirit or scope of the invention, it is intended that all matters contained in the above description or shown in the accompanying drawings shall be interpreted as illustrative and not in a limiting sense.

It is also understood that the following claims are intended to cover all of the generic and specific features of the invention herein described and all statements of the scope of the invention which, as a matter of language, might be said to fall therebetween.

What is claimed is:

1. An amusement device comprising handle means for receiving a power supply therein, light source means releasably mounted to said handle means for emitting a beam of light, a transparent enclosure means having a first end, said transparent enclosure means extending from said light source means so that light passes through said transparent enclosure means, said transparent enclosure means including a plurality of light reflecting objects distributed in a fixed position randomly along the length thereof, said reflecting objects being injection molded within the surfaces of the walls of said transparent enclosure, said reflecting objects being adapted, in combination with the walls of the transparent enclosure to deflect and refract said omitted light in a plurality of directions, said transparent enclosure containing a plurality of light reflecting objects, said reflecting objects being adapted to be randomly scattered within said transparent enclosure so that emitted light is randomly scattered within said enclosure in a plurality of directions when said amusement device is moved.

2. An amusement device, as claimed in claim 1, wherein said transparent enclosure has a lateral wall at said first end and a cap at said second end.

3. An amusement device, as claimed in claim 2, wherein said handle means is comprised of a housing for receiving a power supply within said handle means and for receiving a light bulb and switching means connecting said power supply to said light bulb for controlling the illumination from said light source.

4. An amusement device, as claimed in claim 1, wherein said objects have a reflective surface.

5. An amusement device, as claimed in claim 4, wherein said objects are particles of MYLAR ®.

6. An amusement device, as claimed in claim 1, wherein a plurality of light reflecting elongated streamers are fastened to said second end of said transparent enclosure and said reflecting object deflect said emitted light in a plurality of directions.

7. An amusement device, as claimed in claim 6, wherein said light reflecting objects are strips cut from a sheet, said light reflecting objects having a reflective surface.

* * * * *